US011029022B2

(12) United States Patent
Berard et al.

(10) Patent No.: US 11,029,022 B2
(45) Date of Patent: Jun. 8, 2021

(54) TORCHES, TORCH ASSEMBLIES AND METHODS FOR IGNITING FUEL

(71) Applicant: John Michael Berard, Raleigh, NC (US)

(72) Inventors: John Michael Berard, Raleigh, NC (US); Aly Gamil Khalifa, Raleigh, NC (US); Kias Fredrik Perman, Raleigh, NC (US); Robert Shanks, Raleigh, NC (US)

(73) Assignee: John Michael Berard, Raleigh, NC (US)

( * ) Notice: Subject to any disclaimer, the term of this patent is extended or adjusted under 35 U.S.C. 154(b) by 162 days.

(21) Appl. No.: 16/356,837

(22) Filed: Mar. 18, 2019

(65) Prior Publication Data

US 2019/0293282 A1 Sep. 26, 2019

Related U.S. Application Data

(60) Provisional application No. 62/646,227, filed on Mar. 21, 2018.

(51) Int. Cl.
*F23D 14/06* (2006.01)
*F23D 14/28* (2006.01)
(Continued)

(52) U.S. Cl.
CPC ..... *F23D 14/28* (2013.01); *F23D 14/06* (2013.01); *F23D 14/105* (2013.01); *F23D 14/38* (2013.01); *F23D 14/52* (2013.01); *F23D 14/72* (2013.01)

(58) Field of Classification Search
CPC ..... F23D 14/28; F23D 14/06; F23D 14/105; F23D 14/38; F23D 14/52; F23D 14/72
(Continued)

(56) References Cited

U.S. PATENT DOCUMENTS 1,965,465 A * 7/1934 Magowan ..... F23D 11/10 239/132.5
2,065,627 A * 12/1936 Taylor ..... C21D 1/08 148/641
(Continued)

FOREIGN PATENT DOCUMENTS

EP 2637740 B1 1/2017
RU 75457 U1 8/2008
(Continued)

OTHER PUBLICATIONS

Gas Poker FIRE and BBQ Lighter Gas Cartridge Type NO Gas Bottle Needed, From URL: https://www.amazon.co.uk/Poker-Lighter-Cartridge-Bottle-Needed/dp/B07573XKMW/ref=pd_lpo_vtph_265_bs_t_1/262-3758021-7051031?_encoding . . . (2 pages) (Retrieved Date: Jan. 9, 2019).
(Continued)

*Primary Examiner* — Avinash A Savani
(74) *Attorney, Agent, or Firm* — Myers Bigel, P.A.

(57) ABSTRACT

A torch assembly for igniting a target fuel includes a torch including an elongate wand having a handle end and an opposing forward end, and a torch head located on the forward end of the wand. The torch head has a central axis. The torch head includes an outer surface, a fuel supply chamber, and a plurality of circumferentially spaced apart jet channels fluidly connecting the fuel supply chamber to the outer surface. Each jet channel is configured such that, when a pressurized flow of a gaseous torch fuel is supplied to the jet channels through the fuel supply chamber and ignited, each jet channel directs a respective flame jet forwardly and radially outwardly from the outer surface at an acute angle to the central axis.

18 Claims, 9 Drawing Sheets

(51) Int. Cl.

| | |
|---|---|
| ***F23D 14/72*** | (2006.01) |
| ***F23D 14/38*** | (2006.01) |
| ***F23D 14/52*** | (2006.01) |
| ***F23D 14/10*** | (2006.01) |

(58) Field of Classification Search
USPC ..... 431/344; 126/414
See application file for complete search history.

(56) References Cited

U.S. PATENT DOCUMENTS

| | | | | | |
|---|---|---|---|---|---|
| 2,462,704 | A * | 2/1949 | Zink | F23D 14/00 | 239/543 |
| 3,143,107 | A * | 8/1964 | Lindgren | F23D 91/02 | 431/343 |
| 3,410,261 | A | 11/1968 | Cooper et al. | | |
| 3,589,312 | A | 6/1971 | Cooper | | |
| 3,605,653 | A | 9/1971 | Donnell | | |
| 3,612,037 | A * | 10/1971 | Spiggle | B23K 3/021 | 126/414 |
| 4,422,435 | A | 12/1983 | Spell | | |
| 4,445,846 | A | 5/1984 | Mattingly | | |
| 4,486,044 | A * | 12/1984 | Gordon | F17C 13/084 | 220/630 |
| 4,573,665 | A * | 3/1986 | Strohl | B23K 9/013 | 219/383 |
| 4,625,949 | A * | 12/1986 | Walker | B62B 1/264 | 266/48 |
| 4,919,111 | A | 4/1990 | Ohsawa | | |
| 5,213,075 | A | 5/1993 | Stephen et al. | | |
| 5,327,879 | A | 7/1994 | Ferraro | | |
| 5,800,158 | A | 9/1998 | De Groot | | |
| 6,257,875 | B1 * | 7/2001 | Johnstone | A01M 15/00 | 431/345 |
| 9,097,423 | B2 | 8/2015 | Kraus et al. | | |
| 2006/0035191 | A1 | 2/2006 | Van Vuuren | | |
| 2008/0115777 | A1 | 5/2008 | Hsu | | |
| 2009/0214994 | A1 | 8/2009 | Gdynia | | |
| 2017/0080511 | A1 * | 3/2017 | Jaeger | B23K 9/173 | |

FOREIGN PATENT DOCUMENTS

| | | |
|---|---|---|
| SU | 120187 A | 8/1959 |
| UA | 77801 U | 2/2013 |
| WO | 99/06770 | 2/1999 |

OTHER PUBLICATIONS

Notification of Transmittal of the International Search Report and the Written Opinion of the International Searching Authority, or the Declaration, in corresponding PCT Application No. PCT/US2019/022873 (dated Jun. 20, 2019).

* cited by examiner

TORCHES, TORCH ASSEMBLIES AND METHODS FOR IGNITING FUEL

RELATED APPLICATION

The present application claims the benefit of and priority from U.S. Provisional Patent Application No. 62/646,227, filed Mar. 21, 2018, the disclosure of which is incorporated herein by reference in its entirety.

FIELD

The present invention relates to devices and methods for igniting fuel sources, such as charcoal briquettes in a grill configured to cook foods.

BACKGROUND

Wood, charcoal briquettes and hardwood lump charcoal are three common fuel sources for charcoal grills. The common methods to ignite fuel sources are lighter fluid, starter logs/briquettes, electric lighters and newspaper. The use of lighter fluid to help ignite wood, briquettes or lump charcoal is frequently considered undesirable because lighter fluid can impart bad taste to the food that is being cooked in a grill. Similarly, pre-packaged commercial starter logs/briquettes infused with chemicals can also impart poor taste to food and release harmful fumes. Electric starters are slow and have cords that must be plugged into an electrical outlet. Using newspaper to ignite fuel sources can inefficient and messy.

To avoid the use of these common methods of igniting fuel sources including lighter fluid, an ignition device can be employed to ignite wood, charcoal briquettes or hardwood lump charcoal. Such devices are often driven by propane gas. The gas is delivered to the fuel source using a nozzle or other fuel dispensing mechanism. These ignition devices can be unwieldly, difficult to use, hard to position properly within the grill, problematic to store and dangerous.

SUMMARY

According to some embodiments, a torch assembly for igniting a target fuel includes a torch including an elongate wand having a handle end and an opposing forward end, and a torch head located on the forward end of the wand. The torch head has a central axis. The torch head includes an outer surface, a fuel supply chamber, and a plurality of circumferentially spaced apart jet channels fluidly connecting the fuel supply chamber to the outer surface. Each jet channel is configured such that, when a pressurized flow of a gaseous torch fuel is supplied to the jet channels through the fuel supply chamber and ignited, each jet channel directs a respective flame jet forwardly and radially outwardly from the outer surface at an acute angle to the central axis.

According to some embodiments, the acute angle of each flame jet is in the range of from about 45 to 65 degrees.

In some embodiments, the plurality of j et channels includes at least three jet channels.

In some embodiments, each jet channel has a nominal inner diameter in the range of from about 0.375 to 0.5 inch.

According to some embodiments, each jet channel has a length in the range of from about 0.375 to 0.5 inch.

According to some embodiments, each jet channel terminates at the outer surface at a respective jet port, and the jet ports are substantially equidistantly circumferentially spaced apart.

In some embodiments, the outer surface of the torch head is conical or frusto-conical and tapered inwardly in the forward direction.

In some embodiments, the torch head includes a frusto-conical rear section.

According to some embodiments, the torch assembly further includes a fuel container containing a supply of torch fuel, and a flexible supply hose fluidly connecting the fuel container to the wand. The torch fuel is supplied to the fuel supply chamber from the fuel container through the supply hose and the wand.

In some embodiments, the fuel supply chamber is a combustion chamber.

In some embodiments, the torch assembly further includes an integral electrical igniter operable to generate a spark in the combustion chamber.

In some embodiments, the torch assembly further includes an integral flow control valve on the torch to enable and cut off flow of the torch fuel to the combustion chamber.

According to some embodiments, the torch head includes a flame director that is removably mounted on the wand.

According to some embodiments, a torch system for igniting a target fuel includes an elongate wand having a handle end and an opposing forward end, a first flame director removably mounted on the forward end of the wand, and a second flame director configured to be removably mounted on the forward end of the wand. The second flame director is configured to deliver a different flame pattern than the first flame director.

In some embodiments, the first flame director has a central axis and includes an outer surface, a fuel supply chamber, and a plurality of circumferentially spaced apart jet channels fluidly connecting the fuel supply chamber to the outer surface. Each jet channel is configured such that, when a pressurized flow of a gaseous torch fuel is supplied to the jet channels through the fuel supply chamber and ignited, each jet channel directs a respective flame jet forwardly and radially outwardly from the outer surface at an acute angle to the central axis.

According to some embodiments, a torch system for igniting a target fuel includes a torch assembly and a torch holster. The torch assembly includes a torch, a fuel container, and a flexible supply hose. The torch assembly includes a torch including: an elongate wand having a handle end and an opposing forward end; and a torch head on the forward end of the wand. The fuel container contains a supply of torch fuel. The supply hose fluidly connects the fuel container to the wand. The torch fuel is supplied to the torch head from the fuel container through the supply hose and the wand. The torch holster includes a housing including: a torch slot configured to receive and store the wand and the torch head; a container slot configured to receive and store the fuel container; and a hose region spanning a distance between the torch slot and the container slot and configured to receive and store the supply hose.

In some embodiments, the torch holster further includes a lid configured to close the torch slot, the container slot, and the hose cavity with torch, the fuel container, and the supply house stored in the torch slot, the container slot, and the hose cavity, respectively.

According to some embodiments, the torch holster further includes a lock operable to lock the lid in a closed position.

According to some embodiments, the torch system includes a hanger configured to suspend the torch holster from a grill.

In some embodiments, the torch system includes a stand device configured to support the torch holster in an upstanding position on a support surface.

In some embodiments, the torch holster includes a heat shield.

According to some embodiments, a method for igniting a target fuel includes providing a torch assembly including a torch including: an elongate wand having a handle end and an opposing forward end; and a torch head located on the forward end of the wand. The torch head has a central axis. the torch head includes: an outer surface; a fuel supply chamber; and a plurality of circumferentially spaced apart jet channels fluidly connecting the fuel supply chamber to the outer surface. The method further includes: supplying a pressurized flow of a gaseous torch fuel to the jet channels through the fuel supply chamber; igniting the flow of gaseous torch fuel to provide flame jets from each jet channel; and positioning the torch head proximate the grill fuel such that flame jets are applied to the target fuel. Each jet channel is configured such that it directs a respective flame jet forwardly and radially outwardly from the outer surface at an acute angle to the central axis.

In some embodiments, the torch head includes a first flame director that is removably mounted on the forward end of the wand, and the method includes: removing the first flame director from the forward end of the wand; and mounting a second flame director on the forward end of the wand, wherein the second flame director is configured to deliver a different flame pattern than the first flame director.

According to some embodiments, the target fuel is a grill fuel in a cooking grill.

According to some embodiments, a method for igniting a target fuel includes providing a torch including: an elongate wand having a handle end and an opposing forward end; and a first flame director removably mounted on the forward end of the wand. The method further includes: applying flame to the target fuel from the first flame director; removing the first flame director from the forward end of the wand; and either: remounting the first flame director on the forward end of the wand; or mounting a second flame director on the forward end of the wand, wherein the second flame director is configured to deliver a different flame pattern than the first flame director.

In some embodiments, the target fuel is a grill fuel in a cooking grill.

In some embodiments, the method includes, after removing the first flame director from the forward end of the wand, mounting the second flame director on the forward end of the wand.

According to some embodiments, a method for igniting a target fuel includes providing a torch system including a torch assembly and a torch holster. The torch assembly includes a torch, a fuel container, and a flexible supply hose. The torch includes: an elongate wand having a handle end and an opposing forward end; and a torch head on the forward end of the wand. The fuel container contains a supply of torch fuel. The supply hose fluidly connects the fuel container to the wand. The torch fuel is supplied to the torch head from the fuel container through the supply hose and the wand. The torch holster includes a housing including: a torch slot configured to receive and store the wand and the torch head; a container slot configured to receive and store the fuel container; and a hose region spanning a distance between the torch slot and the container slot and configured to receive and store the supply hose. The method further includes: storing the torch assembly in the torch holster with the wand and the torch head seated in the torch slot, the fuel container seated in the container slot, and the supply hose disposed in the hose region; thereafter removing at least the torch from the torch holster; thereafter applying flame to the target fuel from the torch head; and thereafter replacing the torch in the torch slot.

Further features, advantages and details of the present invention will be appreciated by those of ordinary skill in the art from a reading of the figures and the detailed description of the preferred embodiments that follow, such description being merely illustrative of the present invention.

BRIEF DESCRIPTION OF THE DRAWINGS

The accompanying figures are included to provide a further understanding of the present invention, and are incorporated in and constitute a part of this specification. The drawings illustrate some embodiments of the present invention and, together with the description, serve to explain principles of the present invention.

DESCRIPTION

Figure 1:
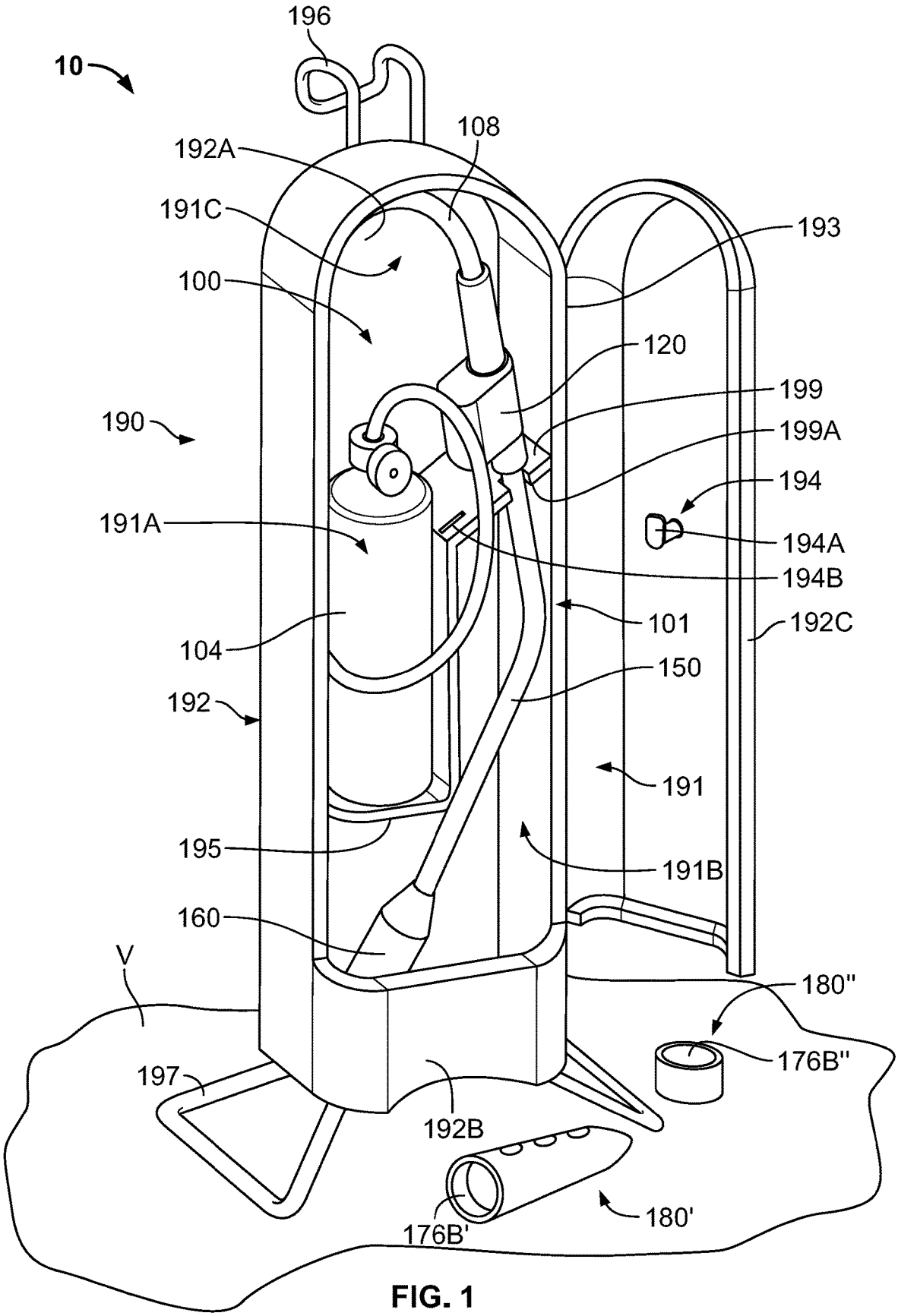
FIG. 1 is a front perspective view of a torch system according to some embodiments.
Figure 3:
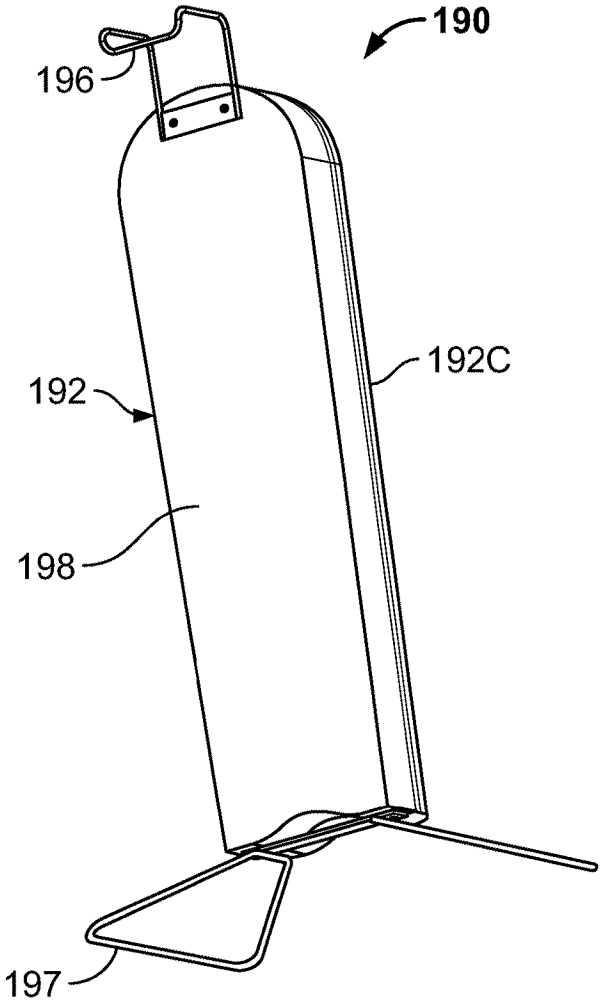
FIG. 3 is a rear perspective view of a holster forming a part of the torch system of FIG. 1.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
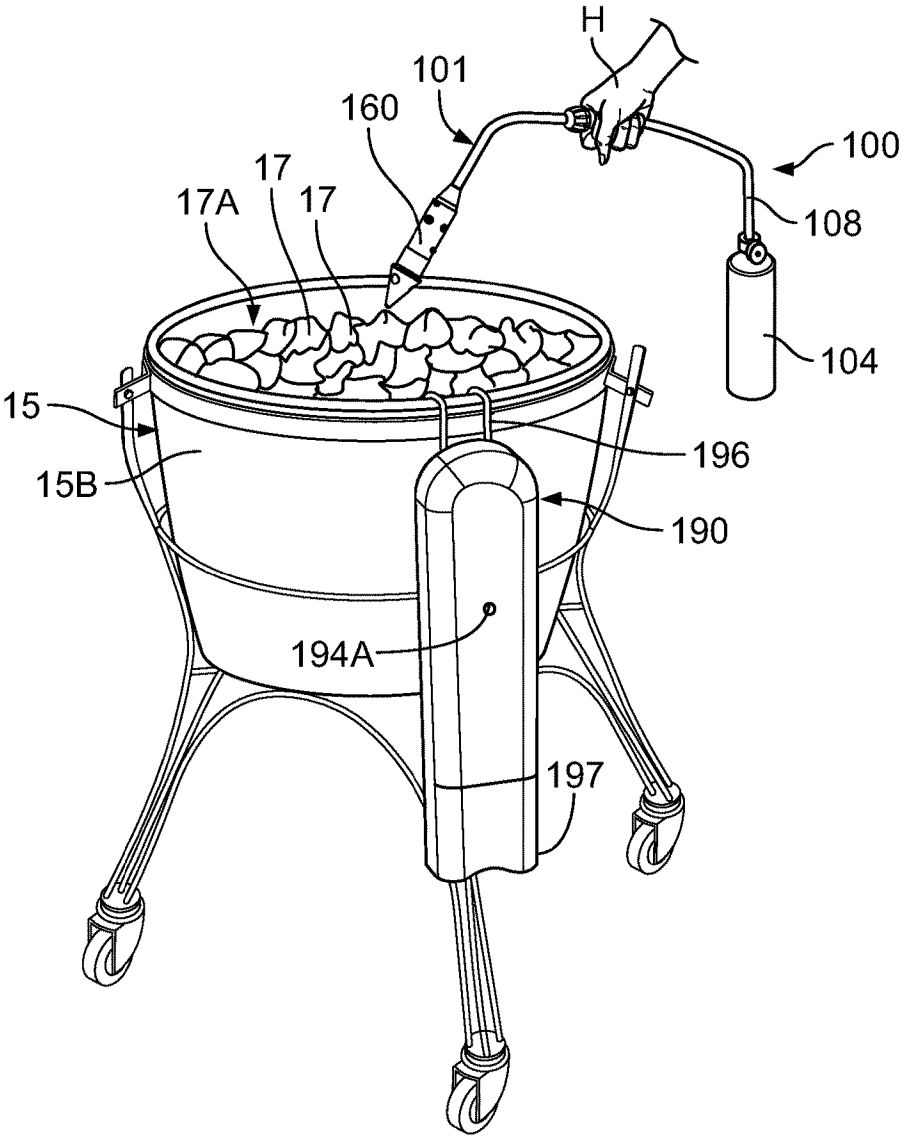
FIG. 2 is a perspective view of the torch system of FIG. 1 being used to light fuel in a grill.
Figure 4:
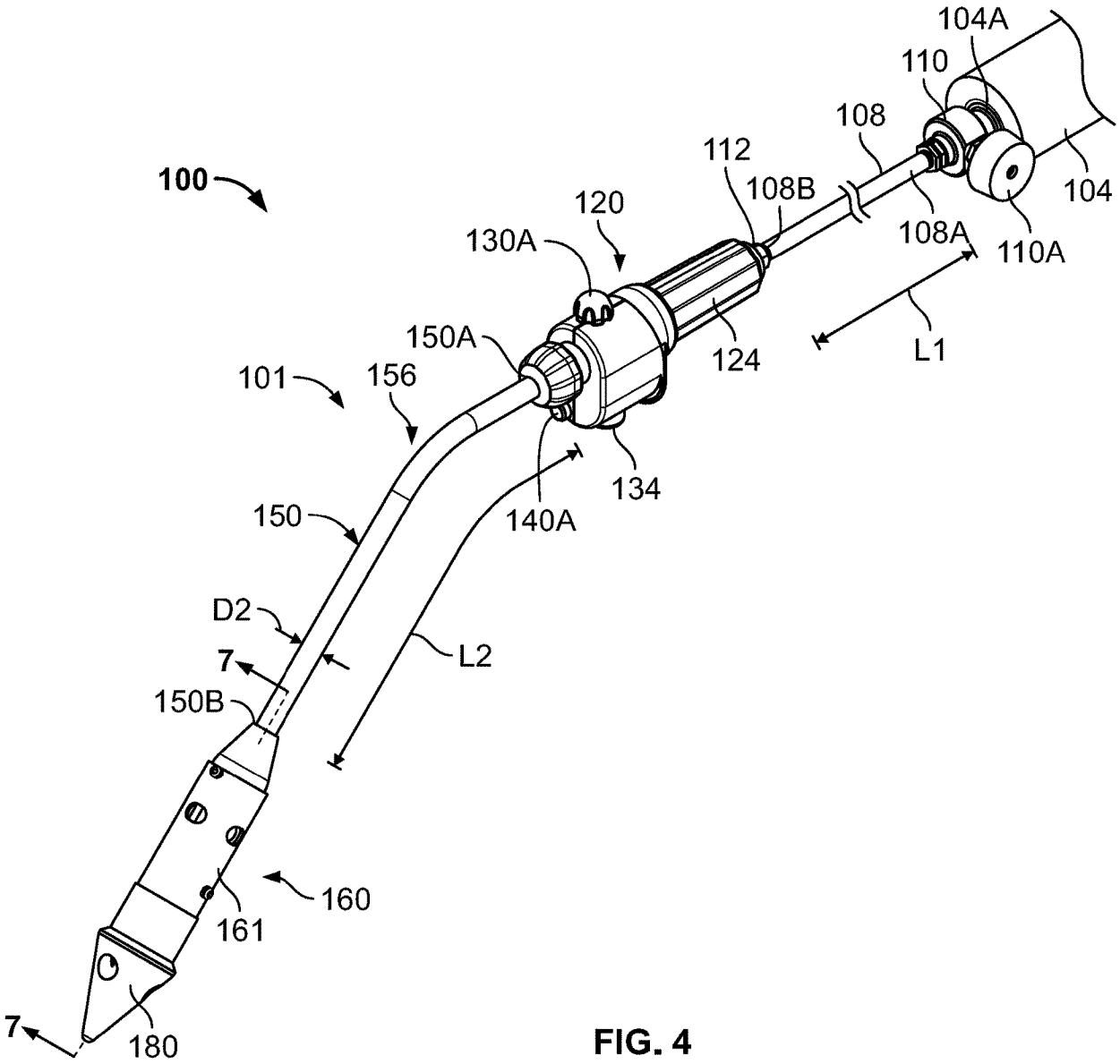
FIG. 4 is a front perspective view of a torch assembly forming a part of the torch system of FIG. 1.
Figure 5:
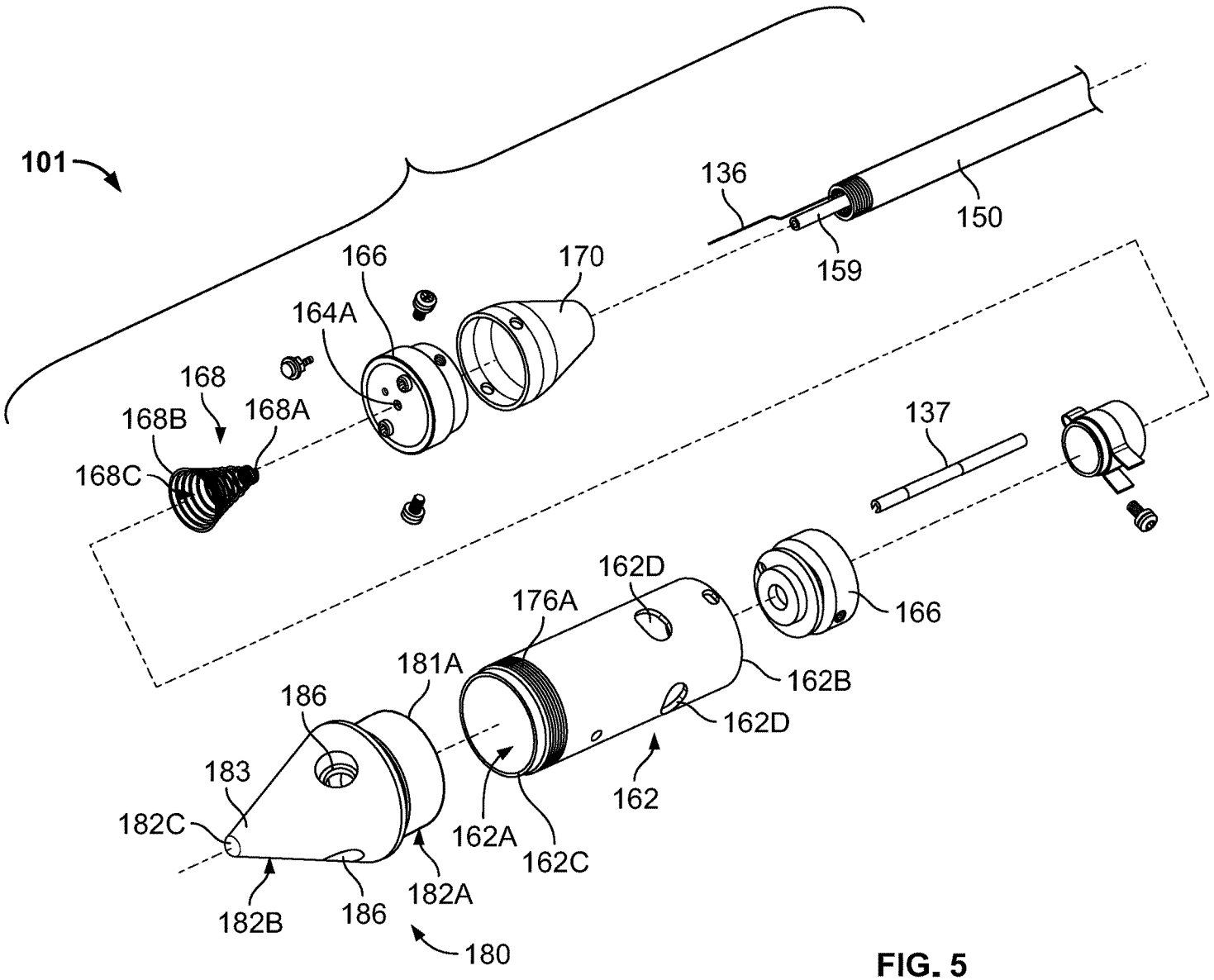
FIG. 5 is a fragmentary, exploded, front perspective view of a torch forming a part of the torch assembly of FIG. 4.
Figure 6:
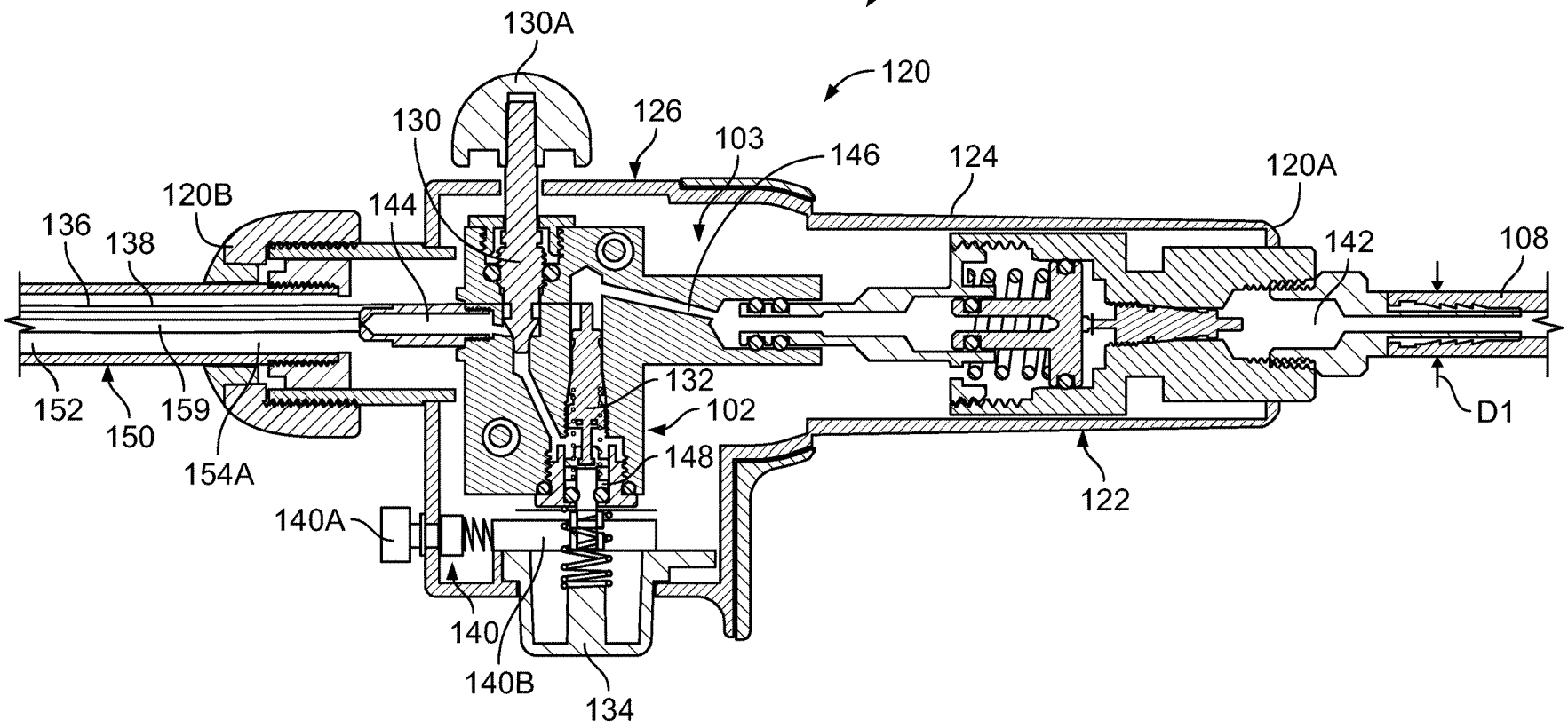
FIG. 6 is a cross-sectional view of the torch assembly of FIG. 4 taken along the line 6-6 of FIG. 4.
Figure 8:
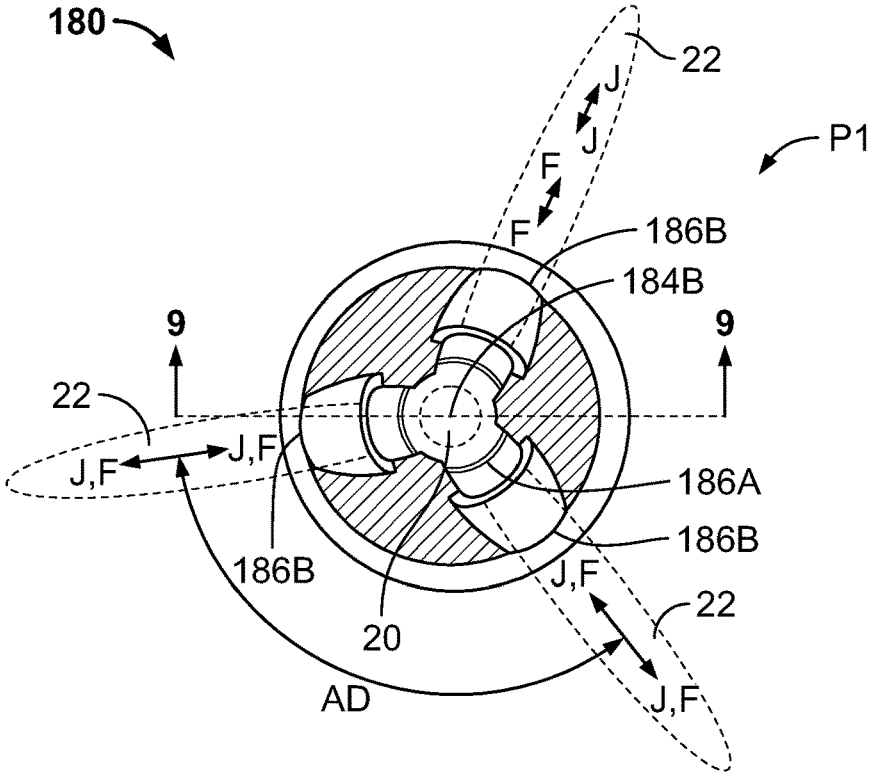
FIG. 8 is a cross-sectional view of the torch assembly of FIG. 4 taken along the line 8-8 of FIG. 7.
Figure 9:
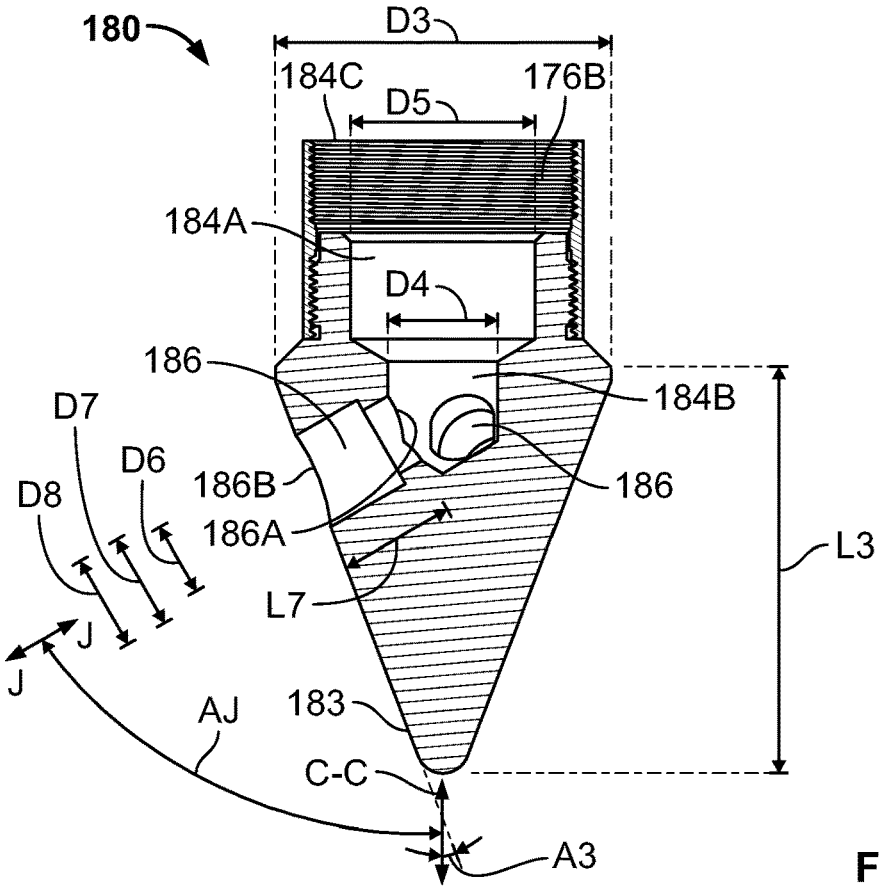
FIG. 9 is a cross-sectional view of the torch assembly of FIG. 4 taken along the line 9-9 of FIG. 8.
Figure 10:
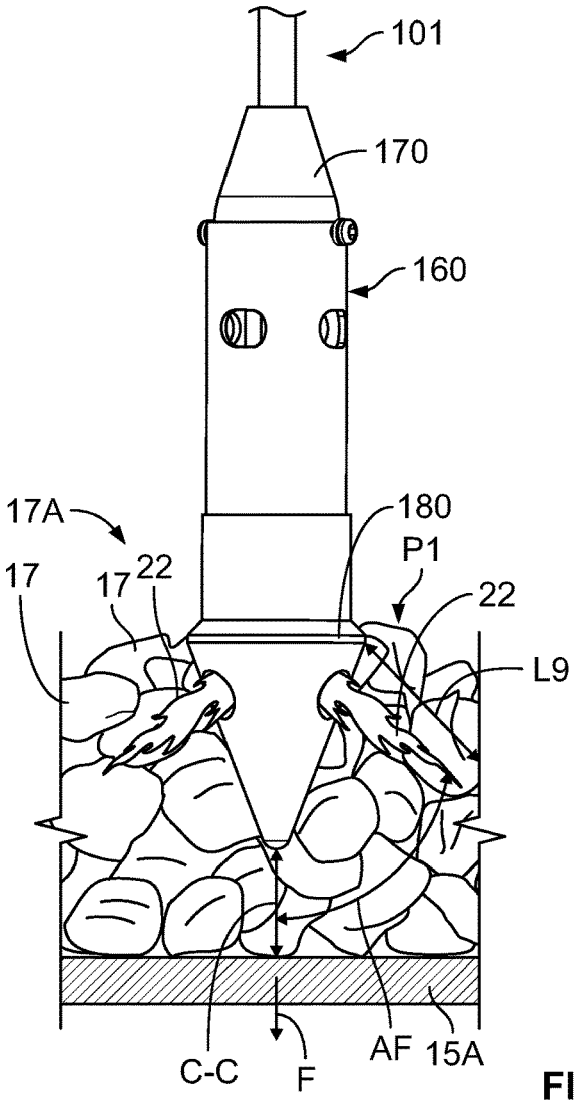
FIG. 10 is a fragmentary, enlarged view of the torch system of FIG. 1 being used to light fuel in the grill.
Figure 11:
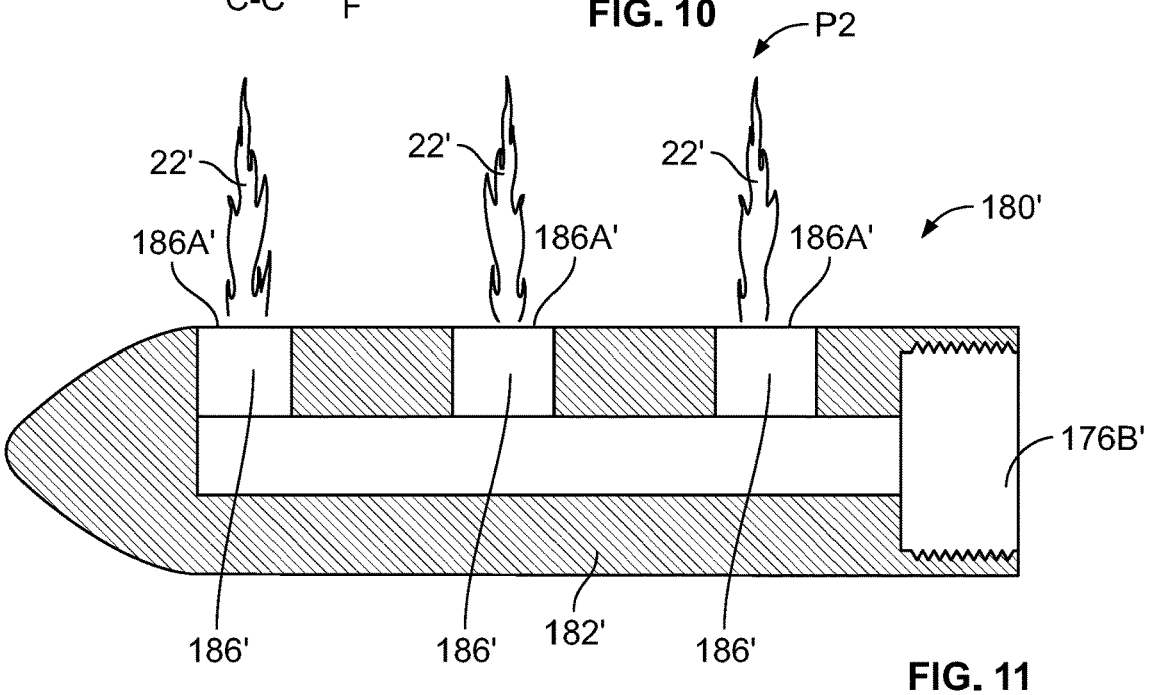
FIG. 11 is a cross-sectional view of a second flame director forming a part of the torch system of FIG. 1.

With reference to FIGS. 1-11, a torch system 10 according to some embodiments is shown therein. The torch system 10 includes a torch assembly 100 and a holder or holster 190. In some embodiments, the system 10 further includes an end ring 180" and/or a second flame director member 180'. The torch system 10 uses combustible torch fuel to generate flame jets 22 and directs the flame jets 22 in an advantageous flame pattern. In accordance with methods of the invention, the torch system 10 is provided and used to ignite a target fuel. In accordance with some methods of the invention, the target fuel is a grill fuel 17 disposed in a cooking grill 15 (FIGS. 2 and 10).

The torch assembly 100 includes a fuel container 104, a valve fitting 110, a flexible fuel supply conduit or hose 108, a fitting 112, and a torch 101. The torch 101 includes a handle unit 120, a rigid elongate wand 150, a torch head 160, an igniter system 102 (FIG. 6), and a fuel control system 103.

Figure 7:
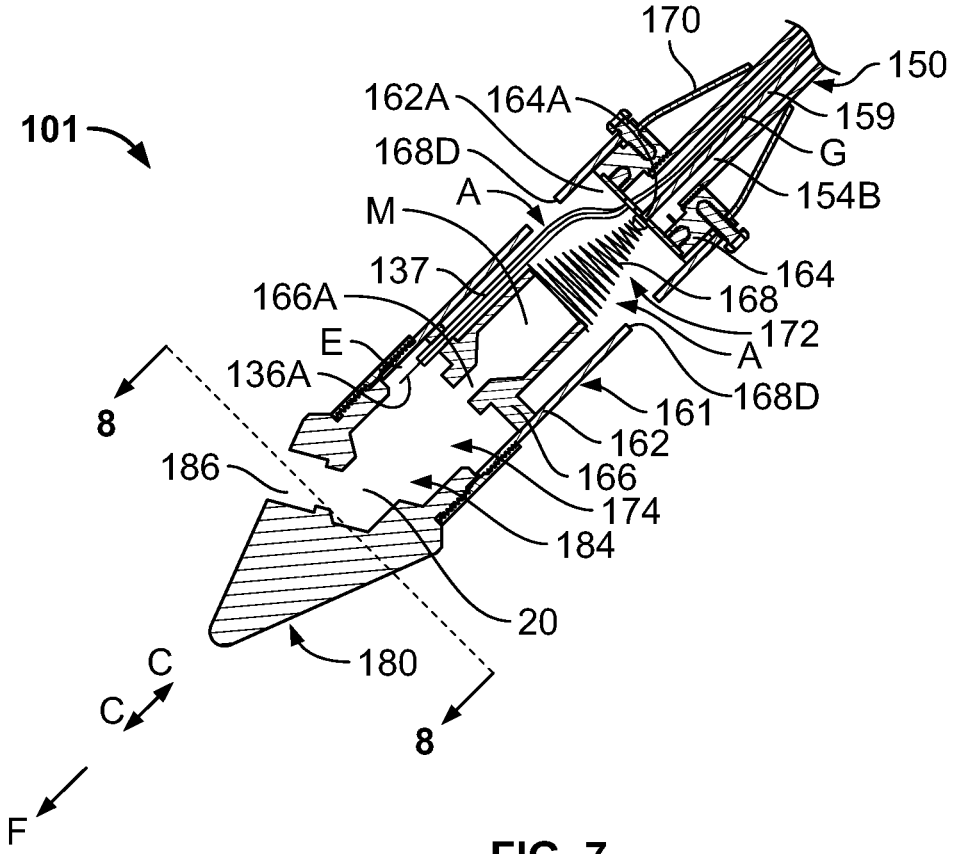
FIG. 7 is a cross-sectional view of the torch assembly of FIG. 4 taken along the line 7-7 of FIG. 4.

The fuel container 104 contains a torch fuel. The fuel container 104 may be any suitable vessel for holding the torch fuel. In some embodiments, the torch fuel is a foam, liquid or gaseous fuel under a positive (above-ambient) pressure that vaporizes to a gas (torch fuel gas G; FIG. 7) at ambient pressure. The fuel container 104 may be a metal canister, for example, having a valved outlet 104A. In some embodiments, the fuel container 104 is substantially cylindrical.

Suitable torch fuels may include, for example, butane, propane, or propene, alone or in mixtures thereof. The torch fuel may be or include a foam. Suitable torch fuels may include a foamed propene, butane and propane mixture available from Gilbert Express of France.

In some embodiments, the fuel container 104 and torch fuel are provided as a disposable, pre-filled torch fuel cartridge including a canister pre-filled (by the manufacturer) with the torch fuel. Suitable pre-filled cartridges may include Gas Cartridge 445 available from Gilbert Express of France, for example.

The hose 108 is tubular, flexible and elongate. A proximal end 108A of the hose 108A is fluidly coupled to the outlet 104A by the valve fitting 110. The valve fitting 110 has a control knob 110A that enables a user to open and shut off flow of the torch fuel into the hose 108.

The hose 108 may be of any suitable construction. In some embodiments, the hose 108 is formed of a polymer and, in some embodiments, an elastomer. In some embodiments, the hose 108 is formed of polytetrafluoroethene (PTFE; e.g., TEFLON™ PTFE). In some embodiments, the hose 108 includes a flexible polymeric conduit surrounded by a flexible metal protective sleeve (e.g., a braided or woven stainless steel sleeve).

In some embodiments, the hose 108 has a length L1 (FIG. 4) in the range of from about 12 to 24 inches.

In some embodiments, the hose 108 has an outer diameter D1 (FIG. 6) in the range of from about 0.375 to 0.5 inches.

In some embodiments, the hose 108 has a minimum bending radius in the range of from about 2 to 3 inches.

The handle unit 120 has a rear end 120A, an opposing front end 120B, and a housing 122. The housing 122 includes a handle section 124 and an integral front section 126.

The handle section 124 is shaped and configured to be ergonomically gripped by a user's hand.

The distal end 108B of the hose 108 is fluidly coupled to an inlet 142 at the proximal end 120A. A through channel 146 extends through the handle unit 120 to an outlet 144 at the front end 120B.

The fuel control system 103 is integrated into the handle unit 120 and includes a shut off valve 148, a spring-loaded trigger button 134, a spring-loaded lock mechanism 140, and a flow rate control valve 130. The shutoff valve 148 is normally closed (i.e., preventing flow of gas through the valve 148 to the outlet 144), and is opened by depressing the trigger button 134.

The lock mechanism 140 includes a lock button 140A. With the trigger button 134 depressed, the lock button 140A can be depressed to cause an interlock feature 140B to interlock with the trigger button 134 and prevent the trigger button 134 from springing back to its closed position. When the trigger button 134 is thereafter depressed further, the lock button 140A is released, thereby disengaging the interlock feature 140B and permitting the trigger button 134 to resume its closed position, which in turn closes the shutoff valve 148. The flow control valve 130 can be used (by adjusting a control knob 130A) to adjust the flow rate of the torch fuel through the handle unit 120 when the shutoff valve 148 is open.

The igniter system 102 includes an igniter mechanism 132 integrated into the handle unit 120, and an igniter lead or wire 136 that extends into and through the wand 150. In some embodiments, the igniter mechanism 132 is a piezo igniter that, when actuated, generates a high voltage and subsequent electrical discharge through the wire 136. The portion of the igniter wire 136 extending throughout the wand 150 is electrically insulated by a polymeric sleeve or layer 138, for example. A distal end section of the wire 136 in the torch head 160 is exposed (i.e., not electrically insulated) and terminates at an exposed wire tip 136A. The wire tip 136A is held in position relative to the barrel 162 by an electrically insulating support holder or sleeve 137 mounted on the end plug 166.

The electrical discharge generates an electrical arc E (i.e., an ignition spark) between the tip 136A and a metal component of the torch head 160 (e.g., the barrel 162), which serves as an electrical ground. The igniter mechanism 132 is connected to the trigger button 134 such that the igniter mechanism 132 is actuated to create the ignition spark by depressing the trigger button 134.

The wand 150 is a rigid, tubular member. The wand 150 defines a through passage 152 terminating at an inlet 154A at a proximal end 150A and at an outlet 154B at a distal end 150B. The wand 150 may include an ergonomic bend 156.

The wand 150 may be formed of any suitable heat resistant material. In some embodiments, the wand 150 is formed of metal.

In some embodiments, the wand 150 has a length L2 (FIG. 4) in the range of from about 10 to 12 inches. In some embodiments, the wand 150 has an outer diameter D2 (FIG. 4) in the range of from about 0.3 to 0.5 inch.

The torch head 160 includes a torch head base 161 and a flame director member or tip 180 mounted on a front end of the torch head base 161. The torch head base 161 includes a barrel 162, a base wall or plug 164, an end wall or plug 166, a flow director spring 168, a base cap 170, and an igniter wire holder 137.

The barrel 162 is tubular. The barrel 162 has a rear end 162B and a front end 162C and defines a through passage 162A. The barrel 162 also has a plurality of radial side ports 162D fluidly communicating with the passage 162A.

The rear end 162B of the barrel 162 is connected to the distal end 150B of the wand 150 by the base plug 164. The base plug 164 includes a through hole 164A that extends through the base plug 164.

A flexible conduit or tubing 159 extends through the wand 150, and fluidly connects the outlet 144 to the hole 164A of the base plug 164.

The end plug 166 is secured in the passage 162A proximate the front end 162C of the barrel 162. The end plug 166 includes a through hole 166A that extends through the end plug 166.

The spring 168 is a helically wound metal wire spring. The diameter of the spring 168 expands from a base end 168A to a front end 168B. The base end 168A surrounds the through hole 164A. The front end 168B mates with the end plug 166. The spring 168 forms an internal flow passage 168C between the base plug hole 164A and the end plug hole 166A.

The tip member or flame director 180 has a central axis C-C. The flame director 180 has a proximal or base end 181A and an opposing distal or tip end 181B spaced apart along the central axis C-C. The flame director 180 includes a base section 182A on the base end 181A and a tip section 182B that terminates at a tip 182C at the tip end 181B.

The tip section 182B has an outer engagement surface 183. In some embodiments and as shown, the outer engagement surface 183 has a conical shape that tapers from a rear end 182D to the tip 182C. The conical shape may be centered about the central axis C-C. As shown, the tip 182C may form a small or narrow rounded tip surface. In other embodiments, the tip 182C may be sharper or broader. In some embodiments, the outer engagement surface 183 is frusto-conical.

In some embodiments, the outer engagement surface 183 tapers at an angle A3 (FIG. 9) in the range of from about 1.5 to 2.5 degrees.

In some embodiments, the length L3 (FIG. 9) of the conical outer engagement surface 183 is in the range of from about 1.75 to 2 inches.

In some embodiments, the maximum outer diameter D3 (FIG. 9) of the conical outer engagement surface 183 is in the range of from about 1.5 to 2 inches.

A plurality jet channels 186 (in some embodiments and as shown, three) are defined in the tip section 182B. A central passage 184 extends from a base opening 184C (at the base end 181A) to the jet channels 186. The central passage 184 has a first entry section 184A and a downstream second section 184B (FIG. 9). The inner diameter D4 (FIG. 9) of the second section 184B is smaller than the inner diameter D5 of the entry section 184A.

A mixing chamber 172 (FIG. 7) is defined in the barrel passage 162B between the base plug 164 and the end plug 166. A combustion chamber 174 is defined in the barrel passage 162B and the tip passage 184 between the end plug 166 and the jet inlets 186A.

Each jet channel 186 extends from an inlet port 186A at the central passage section 184B to an outlet port 186B at the outer surface 183. Each jet channel 186 defines a central jet channel axis J-J extending through its inlet port 186A and outlet port 186B.

The jet channels 186 and the outlet ports 186B are circumferentially distributed and spaced apart from one another about the circumference of the flame director 180. In some embodiments, the jet channels 186 and the outlet ports 186B are substantially equi-distantly circumferentially spaced apart. In some embodiments, the jet channels 186 and the outlet ports 186B are centered about the central axis C-C.

Each jet axis J-J forms an oblique and, more particularly, acute angle AJ (FIG. 9) with the central axis C-C, wherein the acute angle AJ opens in the forward direction F. In some embodiments and as shown, each jet axis J-J substantially intersects the central axis C-C. However, in other embodiments, one or more of the jet axes J-J may be laterally offset from the central axis C-C.

In some embodiments, the jet channels 186 and the outlet ports 186B are circumferentially spaced part from one another by an angular distance AD (FIG. 8) in the range of from about 110 to 130 degrees. However, more than three jet channels 186 may be provided and circumferentially spaced about the torch leach 160 with smaller angular spacing distances.

In some embodiments, each inlet port 186A has a diameter D6 (FIG. 9) in the range of from about 0.25 to 0.375 inch.

In some embodiments, each outlet port 186B has a diameter D7 (FIG. 9) in the range of from about 0.375 to 0.5 inch.

In some embodiments, each jet channel 186 has a length L7 (FIG. 9) in the range of from about 0.375 to 0.5 inch.

In some embodiments, each jet channel 186 has an inner diameter D8 (FIG. 9) in the range of from about 0.375 to 0.5 inch.

In some embodiments, the angle AJ (FIG. 9) is in the range of from about 0 to 90 degrees and, in some embodiments, is in the range of from about 45 to 65 degrees.

The barrel 162, the base plug 164, the end plug 166, and the flame director 180 may each be formed of any suitable heat resistant material. In some embodiments, the barrel 162, the base plug 164, the end plug 166, and the flame director 180 are each formed of metal.

The torch head 160 further includes a coupling system 176 for removably and interchangeably securing the flame director 180 to the torch head base 161. The coupling system 176 includes an outer screw thread 176A on the front end of the barrel 162, and a mating inner screw thread 176B on the rear end of the flame director 180.

In accordance with some embodiments, the torch assembly 101 is stored in the holster 190 when the torch assembly 101 is not in use. The holster 190 includes a housing 192, a lock mechanism 194, an integral hanger 196, and an integral stand support 197.

The housing 192 includes a rear wall member 192A, a front wall member 192B, and a lid 192C that collectively define an internal chamber 191. The lid 192C is coupled to the front wall member 192B by a hinge 193. The lid 192C can be pivoted about the hinge 193 between an open position as shown in FIG. 1 (to permit access to the chamber 191) and a closed position as shown in FIG. 2 (to prevent access to the chamber 191).

The lock mechanism 194 includes a latch member 194A and a catch 194B that can be selectively used to lock the lid 192C in the closed position. In some embodiments, the latch member 194A is a keyed lock. In the illustrated embodiment, the catch 194B is a lock slot defined in the support 199, but may take other forms.

The housing members 192A, 192B, 192C may be formed of any suitable material or materials. In some environments, the housing members 192A, 192B, 192C are formed of a metal such as steel.

The housing 192 may further include a heat resistant thermal insulation or heat barrier or shield member, or layer (e.g., coating), 198. In some embodiments, the heat shield 198 is formed of a material that is more thermally insulating and the material of the rear wall member 192C. Suitable materials for the heat shield 198 may include asbestos, fiberglass, TEFLON™ PTFE, Kevlar, silica, or laminated combinations of one or more of these and other materials, for example.

The housing 192 includes, in the chamber 191, a fuel container region or slot 191A, a torch region or slot 191B, and a hose region, space or slot 191C. As shown in FIG. 1, the fuel container slot 191A is configured to receive, hold and store the fuel container 104, the torch slot 191B is configured to receive, hold and store the torch 101, and the hose slot 191C is configured to receive hold and store the hose 108, while the torch assembly 100 is fully assembled.

The holster 190 includes an integral fuel container shelf 195 that supports the fuel container 104 in the slot 191A above the floor of the chamber 191.

The holster 190 further includes an integral torch shelf 199 that supports the torch 101 in the slot 191B above the floor of the chamber 191. The torch shelf 199 includes a recess or slot 199A sized to receive the wand 150 but too small to permit the hand unit 120 to pass through. The torch 101 is seated in the slot 199A and the slot 191B as shown in FIG. 1 such that the torch 101 is positively located in the chamber 191 and the torch head 160 resides under the fuel can 104. The flow director 180', the ring 180", and/or a spare fuel canister can be stored in the space to the right of the torch head 160. The stand support 197 may be detachable from the housing 192. In some embodiments, the support 197 is detachably secured to the housing 192 such as by fasteners.

The end ring 180" is an annular metal body having an internal screw thread 176B" configured to mate with the coupling thread 176A on the barrel 162.

The second flame director member 180' includes a tubular body 182'. A plurality of j et channels 186' are defined in the body 182'. The jet channels 186' terminate at respective flame outlet ports 186A' that are arranged in axial series along the length of the body 182'. The outlet ports 186A' are located on the same lateral side of the body 182'. The second flame director member 180' has an internal screw thread 176B' configured to mate with the coupling thread 176A on the barrel 162.

The end ring 180" and the flame director 180' may each be formed of any suitable heat resistant material. In some embodiments, the end ring 180" and the flame director 180' are each formed of metal.

The torch system 10 may be used as follows in accordance with methods of the invention.

The torch system 10 may be used to ignite grill fuel 17 disposed in a grill 15. Typically, the grill 15 will include a substrate or floor 15A that supports the grill fuel 17 and a surrounding housing or structure. The grill housing may include a sidewall 15B, for example. The grill 15 may be of the type configured to heat, cook and/or grill foods such as meat for human consumption.

The grill fuel 17 may be any suitable grill fuel or fuel source. In some embodiments, the grill fuel 17 is or includes charcoal. In some embodiments, the grill fuel 17 includes wood. In some embodiments, the grill fuel 17 includes hardwood charcoal. In some embodiments, the grill fuel 17 is or includes hardwood lump charcoal and/or charcoal briquettes or other discrete grill fuel elements. In some embodiments, the grill fuel 17 is arranged as a pile 17A of grill fuel lumps or briquettes that are positioned in stacked and side-by-side, closely packed (e.g., touching) relation.

In some embodiments, the target fuel is wood or other combustible fuel that is not disposed in a cooking grill. For example, the target fuel may instead be wood disposed in a fireplace or firepit.

The torch assembly 100 may initially be stored in the holster 190. In some embodiments, the holster 190 is hung by the hanger 196 from the grill 15, so that the torch assembly 100 is thereby suspended from the grill 15. For example, the hanger 196 may be placed over the sidewall 15B. The support 197 may be removed from the holster 190. In other embodiments, the holster 190 is placed on a supporting surface V (e.g., the ground or a table) and the housing 192 is held upright by the support 197.

As can be seen in FIG. 1, the fuel container 104 is disposed in the fuel container slot 191A, the torch 101 is stored in the torch slot 191B, and the hose 108 is stored in the hose slot 191C such that the hose 108 spans the distance between the fuel container slot 191A and the torch slot 191B.

In use, the torch 101 is removed from the holster 190 and used to ignite the grill fuel 17 as discussed below. In some embodiments, the fuel container 104 is retained in the fuel container slot 191A and the torch 101 is permitted by the length and flexibility of the fuel supply hose 108 to move about the grill 15 while the container 104 remains seated in the slot 191A. The torch 101 can then be used one-handed after the valve 110 is turned on. In other embodiments, the entire torch assembly 100 is removed from the holster 190 enable the user to position the torch 101 as needed.

The top knob 110A is then operated to open the valve 110 and thereby permit gaseous torch fuel G to pass from the fuel container 104 and through the hose 108 into the handle unit 120. The user grips the handled unit 130 with the user's hand H (FIG. 2). The user then presses the trigger button 134 to open the shut off valve 148. This permits the gaseous torch fuel to flow through the handle unit 120, the tubing 159 in the wand 150, and the torch head 160. Flow of the gaseous torch fuel is induced by the positive pressurization of the torch fuel in the fuel container 104.

At the torch head 160, the torch fuel G flows through the base hole 164A, the barrel passage 162A, and the end hole 166A into the combustion chamber 174. As the torch fuel G flows through the mixing chamber 172 in the barrel passage 162A it is partially contained by the spring 168 within the spring passage 168C. Also, as the torch fuel G flows through the barrel passage 162A, the torch fuel mixes with ambient air drawn in through the side ports 162D. As a result, a gas mixture M of the torch fuel gas G and air A is introduced into the combustion chamber 134 through the end hole 166A. In some embodiments, the velocity of the flowing torch fuel generates a negative pressure within the barrel passage 162A that tends to draw ambient air A into the barrel passage 162A through the side ports 162D.

Pressing the trigger button 134 also actuates the igniter mechanism 132 to generate an arc or spark E between the igniter wire tip 136A and the barrel 162 in the combustion chamber 174. The spark E ignites the fuel/air mixture gas M.

With the trigger button 134 still depressed, the user can depressed the lock button 140A. With the lock button 140 depressed, the user can then release the trigger button 134. The trigger button 134 is thereby locked in the shutoff valve open position, so that the torch fuel G will continue to flow through the handle unit 122 and the torch head 160.

The user can regulate the flow rate of the torch fuel G (when the shut off valve 148 is open) by adjusting the flow rate control valve knob 130A.

The ignited fuel/air mixture gas M becomes flame 20 in the combustion chamber 174 that is ejected or forced outwardly from the combustion chamber 174 through the jet channels 186 as flame jets 22 (FIGS. 8 and 10). Each flame jet 22 projects outwardly from its respective jet channel 186 beyond the flame director outer surface 183 at a prescribed orientation and direction as discussed below. The flame jets 22 collectively form a flame jet pattern P1 (FIGS. 8 and 10).

Before or after igniting the torch fuel G as described above, the user places the flame director 180 in the vicinity of the grill fuel 17 so that the claimed jets 22 contact or impinge on the grill fuel 17. In some embodiments, the user embeds the flame director 180 in the pile 17A of the grill fuel 17 (as shown in FIG. 10, for example). In some embodiments, the grill fuel 17 directly contacts the outer surface 183 of the flame director 180. The relatively long wand 150 can enable the user to locate the torch head 160 down low into a deep grill cavity while maintaining the user's hands outside the grill cavity or a safe distance from the grill fuel 17.

The user may position and reposition the flame director 180 within and above the grill fuel 17 as long as desired to ignite the grill fuel 17. When the user wishes to shut off the torch fuel to the torch head 160, the user can again depress the trigger button 134 to disengage the lock mechanism 140, and release the trigger button 134 to close the shut off valve 148. Thereafter, the user may return the torch 101 (and the torch assembly 100, if fully removed) to the holster 190.

The tapered front surface 183 of the flame director 180 and the tapered rear surface of the base cap 170 may make it easier to penetrated the grill fuel 17 with the torch head 160 and reduce disruption to the grill fuel 17 caused by inserting and removing the torch head 160.

The operation of the torch head 160 and the jet channels 186 may be better appreciated with reference to FIGS. 8 and 10. Each flame jet 22 has a flame jet axis or vector F-F. The positive pressure of the pressurized supplied torch fuel gas G and the combustion of the gas mixture M drive or force the flame jets 22 to project outwardly through the outlet ports 186B beyond the outer surface 183. More particularly, each flame jet 22 projects forwardly and radially outwardly from the outer surface 183. That is, the primary projection direction or flame vector F-F of each flame jet 22 includes a forward component (i.e., in the forward direction F) and a radially outward component (e.g., radially outward from the central axis C-C).

In some embodiments, each jet channel 186 directs its flame jet 22 at an acute angle AF (FIG. 10) relative to the central axis C-C. In some embodiments, the angle AF is substantially the same as the corresponding jet angle AJ (FIG. 10).

In some embodiments, each angle AF is in the range of from about 0 to 90 degrees and, in some embodiments, is in the range of from about 45 to 65 degrees.

In some embodiments, the length L9 (FIG. 10) of each flame jet 22 is in the range of from about 1 to 8 inches. The length L9 can be adjusted using the flow control valve 130A.

The forwardly and radially directed flame jet pattern P1 increases dispersion of the flame to the grill fuel 17. This may assist in igniting the grill fuel 17 more quickly, widely and evenly.

The flame director 180 is removable, replaceable and interchangeable using the coupling system 176. The flame director 180 can be unscrewed from the barrel 162 and then screwed back onto the barrel 162 for re-use. For example, the flame director 180 and/or the remainder of the torch head 160 may be cleaned with the flame director 180 removed.

The second flame director 180' may be screwed onto the barrel 162 in place of the first flame director 180. The second flame director 180' directs flame jets 22' from the outlet ports 186B' in a second flame pattern P2 that is different from the flame pattern P1. In some embodiments, the second flame pattern is better suited for igniting a stack of fuel (e.g., a pile of logs) from underneath.

Alternatively, the end ring 180" may be screwed onto the barrel 162 in place of the flame director 180. The end ring 180" protects the threads 176A from dirt and damage. The torch 101 can be used in this configuration also, in which case a third flame pattern is generated. In the third flame pattern, a single large flame jet is directed forwardly.

The coupling system 176 may include different coupling features or mechanisms in place or in addition to the threads 176A, 176B, 176B', 176B" to removably secure the flame directors 180, 180' and the end ring 180" to the barrel 162.

Figure 12:
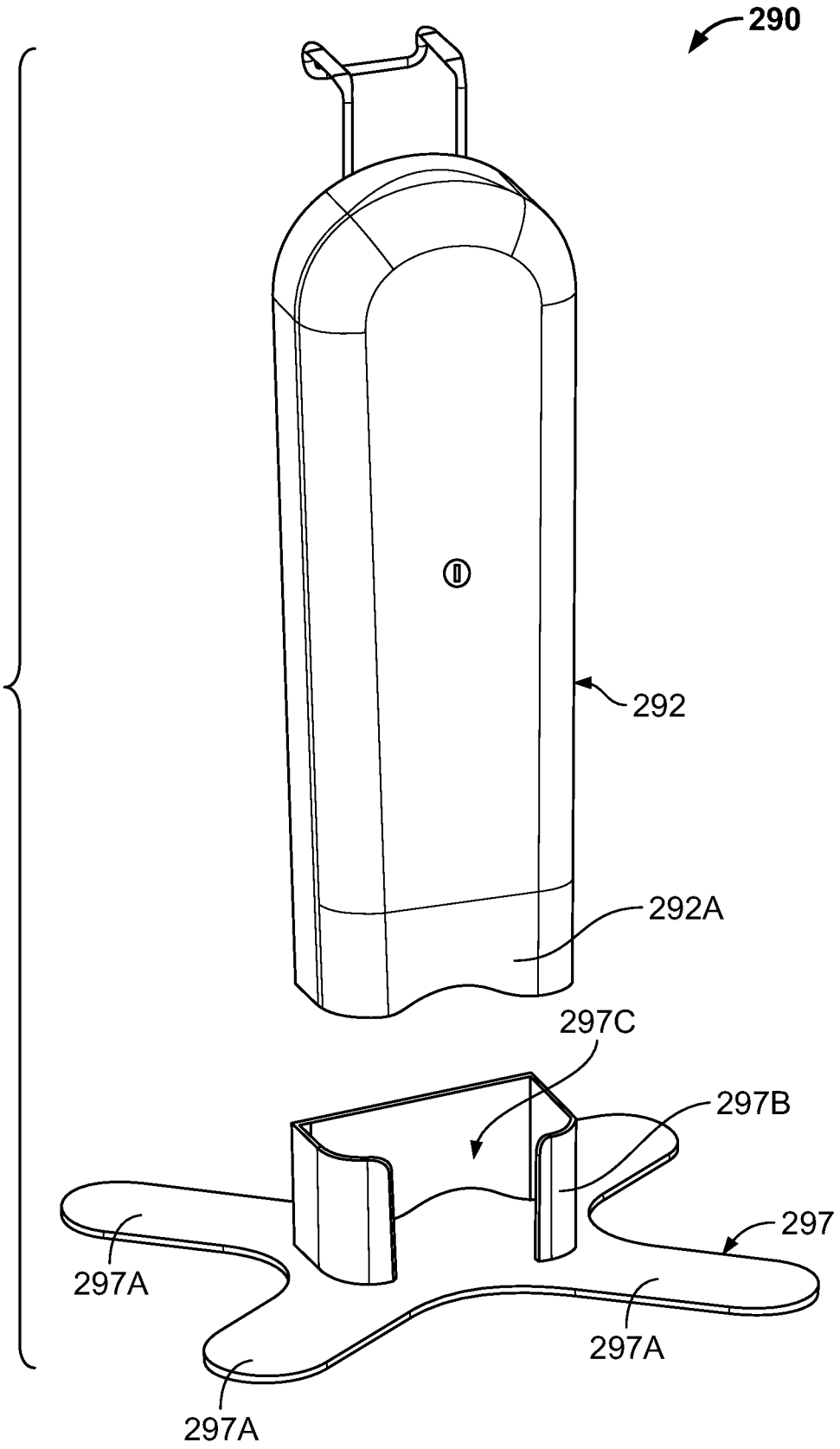
FIG. 12 is an exploded, front perspective view of a holster according to further embodiments.

With reference to FIG. 12, a holster 290 according to further embodiments is shown therein. The holster 290 may be constructed and used in the same manner as the holster 190, except as follows.

The holster 290 includes a housing 292 (corresponding to the housing 192) and a support stand or base 297. The base 297 includes laterally extending feet 297A and an integral upstanding sleeve or receptacle 297B defining a receiver slot 297C. The housing 292 can be inserted into the receptacle 297B such that a lower end portion 292A of the housing 292 is seated in the slot 297C to support the housing 292 in a freestanding configuration. The housing 292 can be slid out of the receptacle 297B to remove the base 297 from the housing 292 when the base 297 is not desired (e.g., the holster is being hung). In some embodiments, the lower portion 292A fits snugly in the slot 297C. The snug fit and the weight of the housing 292 will keep the housing 292 stably within the stand 297.

Many alterations and modifications may be made by those having ordinary skill in the art, given the benefit of present disclosure, without departing from the spirit and scope of the invention. Therefore, it must be understood that the illustrated embodiments have been set forth only for the purposes of example, and that it should not be taken as limiting the invention as defined by the following claims. The following claims, therefore, are to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the invention.

What is claimed:

1. A torch assembly for igniting a target fuel, the torch assembly comprising:

a torch including:

an elongate wand having a handle end and an opposing forward end; and a torch head located on the forward end of the wand, the torch head having a central axis and including:

an outer surface;

a combustion chamber; and a plurality of circumferentially spaced apart jet channels fluidly connecting the combustion chamber to the outer surface;

wherein the torch head is configured such that, when a pressurized flow of a gaseous torch fuel is supplied to the combustion chamber and ignited, a flame is generated in the combustion chamber and is forced outwardly from the combustion chamber through each of the jet channels as a respective flame jet, and each jet channel directs its respective flame jet forwardly and radially outwardly from the outer surface at an acute angle to the central axis.

2. The torch assembly of claim 1 wherein the acute angle of each flame jet is in the range of from about 45 to 65 degrees.

3. The torch assembly of claim 1 wherein the plurality of jet channels includes at least three jet channels.

4. The torch assembly of claim 1 wherein each jet channel has a nominal inner diameter in the range of from about 0.375 to 0.5 inch.

5. The torch assembly of claim 1 wherein each jet channel has a length in the range of from about 0.375 to 0.5 inch.

6. The torch assembly of claim 1 wherein each jet channel terminates at the outer surface at a respective jet port, and the jet ports are substantially equidistantly circumferentially spaced apart.

7. The torch assembly of claim 1 wherein the outer surface of the torch head is conical or frusto-conical and tapered inwardly in the forward direction.

8. The torch assembly of claim 1 wherein the torch head includes a frusto-conical rear section.

9. The torch assembly of claim 1 further including:

a fuel container containing a supply of torch fuel; and a flexible supply hose fluidly connecting the fuel container to the wand;

wherein the torch fuel is supplied to the combustion chamber from the fuel container through the supply hose and the wand.

10. The torch assembly of claim 1 further including an integral electrical igniter operable to generate a spark in the combustion chamber to generate the flame in the combustion chamber.

11. The torch assembly of claim 10 further including an integral flow control valve on the torch to enable and cut off flow of the torch fuel to the combustion chamber.

12. The torch assembly of claim 1 wherein the torch head includes a flame director that is removably mounted on the wand, and the jet channels are defined in the flame director.

13. A torch system for igniting a target fuel, the torch system comprising:

an elongate wand having a handle end and an opposing forward end;

a first flame director removably mounted on the forward end of the wand; and a second flame director configured to be removably mounted on the forward end of the wand;

wherein the first flame director is configured to deliver a first flame pattern, and the second flame director is configured to deliver a second flame pattern that is different than the first flame pattern; and wherein:

the first flame director has a central axis and includes:

an outer surface; and a plurality of circumferentially spaced apart jet channels extending to the outer surface; and each jet channel is configured to direct a respective flame jet forwardly and radially outwardly from the outer surface at an acute angle to the central axis to form the first flame pattern.

14. The torch system of claim 13 wherein:

the second flame director has a lengthwise axis and includes:

a second outer surface; and a plurality of second jet channels arranged in axial series along the lengthwise axis and extending to the second outer surface; and each second jet channel is configured to direct a respective second flame jet radially outwardly from the second outer surface to form the second flame pattern.

15. A torch system for igniting a target fuel, the torch system comprising:

an elongate wand having a handle end and an opposing forward end;

a first flame director removably mounted on the forward end of the wand; and a second flame director configured to be removably mounted on the forward end of the wand;

wherein the first flame director is configured to deliver a first flame pattern, and the second flame director is configured to deliver a second flame pattern that is different than the first flame pattern; and wherein:

the torch system includes a combustion chamber on the forward end of the wand;

the first flame director includes:

an outer surface; and a plurality of spaced apart jet channels fluidly connecting the combustion chamber to the outer surface; and the torch system is configured such that, when a pressurized flow of a gaseous torch fuel is supplied to the combustion chamber and ignited, a flame is generated in the combustion chamber and is forced outwardly from the combustion chamber through the jet channels as respective flame jets to form the first flame pattern.

16. The torch system of claim 15 further including an integral electrical igniter operable to generate a spark in the combustion chamber to generate the flame in the combustion chamber.

17. A method for igniting a target fuel, the method comprising:

providing a torch including:

an elongate wand having a handle end and an opposing forward end; and a first flame director removably mounted on the forward end of the wand;

applying flame to the target fuel from the first flame director;

removing the first flame director from the forward end of the wand; thereafter mounting a second flame director on the forward end of the wand; and thereafter applying flame to the target fuel or a second target fuel from the second flame director;

wherein the first flame director is configured to deliver a first flame pattern, and the second flame director is configured to deliver a second flame pattern that is different than the first flame pattern; and wherein the target fuel is a grill fuel in a cooking grill.

18. A method for igniting a target fuel, the method comprising:

providing a torch including:

an elongate wand having a handle end and an opposing forward end; and a first flame director removably mounted on the forward end of the wand;

applying flame to the target fuel from the first flame director;

removing the first flame director from the forward end of the wand; thereafter mounting a second flame director on the forward end of the wand; and thereafter applying flame to the target fuel or a second target fuel from the second flame director:

wherein the first flame director is configured to deliver a first flame pattern, and the second flame director is configured to deliver a second flame pattern that is different than the first flame pattern; and wherein:

the torch includes a combustion chamber on the forward end of the wand;

the first flame director includes:

an outer surface; and a plurality of spaced apart jet channels fluidly connecting the combustion chamber to the outer surface; and the method includes:

supplying a pressurized flow of a gaseous torch fuel to the combustion chamber; and igniting the gaseous torch fuel in the combustion chamber to generate a flame in the combustion chamber that is forced outwardly from the combustion chamber through the jet channels as respective flame jets to form the first flame pattern.

* * * * *